US010486774B1

(12) United States Patent
Sheng et al.

(10) Patent No.: US 10,486,774 B1
(45) Date of Patent: Nov. 26, 2019

(54) CONSTANT TENSION ANCHORING SYSTEM

(71) Applicant: GUANGZHOU INSTITUTE OF ENERGY CONVERSION, CHINESE ACADEMY OF SCIENCES, Guangzhou (CN)

(72) Inventors: Songwei Sheng, Guangzhou (CN); Shuo Huang, Guangzhou (CN); Kunlin Wang, Guangzhou (CN); Hongjun Lin, Guangzhou (CN); Zhenpeng Wang, Guangzhou (CN); Yaqun Zhang, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 0 days.

(21) Appl. No.: 16/234,516

(22) Filed: Dec. 27, 2018

(30) Foreign Application Priority Data

Aug. 30, 2018 (CN) ..... 2018 1 1003944

(51) Int. Cl.
*B63B 21/46* (2006.01)
*B63B 21/50* (2006.01)
*B63B 21/18* (2006.01)

(52) U.S. Cl.
CPC ..... *B63B 21/46* (2013.01); *B63B 21/50* (2013.01); *B63B 21/18* (2013.01)

(58) Field of Classification Search
CPC ..... B63B 21/46; B63B 21/50; B63B 21/18
See application file for complete search history.

(56) References Cited

U.S. PATENT DOCUMENTS 4,348,975 A * 9/1982 Dove ..... B63B 21/22 114/210
4,841,898 A * 6/1989 Ballantyne ..... B63B 21/22 114/230.23
2002/0189522 A1* 12/2002 Dove ..... B63B 21/04 114/293
2004/0231579 A1* 11/2004 Macrae ..... B63B 21/20 114/293
2005/0241558 A1* 11/2005 Barlow ..... B63B 21/04 114/200
2011/0192336 A1* 8/2011 strand ..... B63B 21/50 114/230.2
2015/0259043 A1* 9/2015 Bauer ..... B63B 21/50 114/312

* cited by examiner

*Primary Examiner* — Stephen P Avila
(74) *Attorney, Agent, or Firm* — Gokalp Bayramoglu

(57) ABSTRACT

A constant tension anchoring system mounted on a floating body in the ocean includes an anchor, an anchor chain, an anchor windlass, a towing cable, a load and a chain stopper. During the oscillatory motion of the waves, the constant tension anchoring system repeats the release and retraction so as to maintain a generally constant tension force and thereby ensure the safety of the anchoring system and the floating body.

18 Claims, 3 Drawing Sheets

CONSTANT TENSION ANCHORING SYSTEM

CROSS REFERENCE TO THE RELATED APPLICATIONS

This application is based upon and claims priority to Chinese Patent Application No. 201811003944.9, filed on Aug. 30, 2018, the entire contents of which are incorporated herein by reference.

TECHNICAL FIELD

The present invention relates to the anchoring technical field, and particularly to a constant tension anchoring system.

BACKGROUND

Ships and offshore floating bodies operate in the ocean over a long period of time, while storms and even typhoons occur frequently in the ocean, and thus storm attacks are the greatest threat to ships and offshore floating bodies. Every year, disasters such as casualties, property loss and water pollution, which are caused by failure of ships and floating bodies to escape from storms and typhoons, are countless. At present, the main approaches adapted to prevent disasters for ships and floating bodies, are simply avoiding, or enhancing the anchoring systems. The fundamental dilemma for these technologies is that the ocean provides formidable engineering challenges which must be solved to ensure survivability in extreme conditions, such as Typhoons, and provide robust, reliable and low-cost solution.

When a storm comes, not every ship can find a suitable area to avoid the storm; for conventional catenary anchoring systems, the chains will be quickly straightened in the storm. In long periodic waves, if a ship keeps moving away as following the waves in the storm, the huge kinetic energy generated by the movement of the ship cannot be depleted, resulting in dragging anchor or chain breakage, and subsequently the ship being out of control and disasters. Some ships and floating bodies have increased the chain diameter, adapted more chains, or enhanced the anchor structure, all of which are for the purpose of increasing the minimum break load; these solutions have enhanced the anchoring system with huge anchoring costs, but do not fundamentally change the possibility of the ships being destroyed in the storms or even typhoons. Under the action of ocean currents and long periodic waves, the chains with buffering capacity are stretched by the ocean currents, and the inextensible anchor chain still faces the threat of being straightened to break by the long periodic waves in typhoon. Some immobile floating platforms have introduced ropes with greater flexibility for anchoring, or introduced weights and pontoons to the anchoring system, in order to increase the elastic links in the anchoring system; the above solutions alleviate the problem of lacking elasticity of anchoring system, however, as the moving distance of the floating body increases, the effective buffering capacity of the elastic links are depleted to finally reach a rigid state, and thereby the anchoring system still faces the threat of dragging anchor or anchoring line breakage. Also, since the anchoring force and the chain retraction of the floating platform are opposite in direction but equal in magnitude, the force on the floating structure increases as the anchoring force increases, which is a huge threat to the safety of the structure itself; the excessive force on the structure can cause structural failure of the ships and floating platforms or ship sinking. Therefore, the problem that which anchoring solution shall be adapted to enable ships and floating bodies to survive in storms or even typhoons has not been effectively addressed.

The major cause of ships and floating bodies frequently suffering from damages is that, under the action of wind, ocean currents and long periodic waves, neither the conventional catenary systems with only anchor chains nor the improved anchoring systems with introduced elastic links can change the fact that, they will be straightened due to their limitation in length and elasticity, resulting in a rapidly increasing anchoring tension which will exceed the breaking value of the anchoring material and cause fracture and failure of the anchoring system, and thereby accidents of ships and floating bodies, such as shifting, grounding or crashing will occur. In addition, an excessively enhancing anchoring system also increases the force on the ship or the floating structure in the storm, which will increase the probability of local damage to the ship or the floating body.

SUMMARY

One object of the present invention is to maintain a constant tension for ships, floating bodies and their anchoring systems during a storm, so as to completely avoid the possibility of the anchoring system being straightened and the structure being damage due to excessive force. A constant tension anchoring system is provided in order to achieve the above object. The solution of the present invention is provided based on an accurate analysis on ships and floating bodies about their movements and the force thereon in the storm. When ships and floating bodies on the sea encounter a storm, they are mainly subjected to three kinds of forces. The first is a wind force with a substantially constant direction, the second is an ocean current force with a substantially constant direction, and the third is a wave force undergoing an oscillatory action. The first and the second forces can be regarded having constant directions and magnitudes; in the case where the shape of the ship or the floating body is basically defined, an anchoring system can only resist these forces but is incapable of alleviating them, and thus the anchoring system should be designed to be capable of resisting these two forces safely. The third force is different from the other two, as waves relate to oscillatory motion. The water mass particles which constitute the waves in the ocean move in approximately an elliptical trajectory around a center thereof, and a floating body in the waves follows the waves to perform an oscillating motion. Floating structures of different forms may have different amplitudes in the waves, but their motion modes are basically identical; thus, although a floating body will move backwards significantly in the waves, in view of one complete wave cycle, the floating body will basically return to the original position that it performs an oscillatory motion in the waves which is similar to the water mass particles. Storms and typhoons relate to ultra-long waves, a floating body will follow the waves under the action of long periodic waves. Because the wavelength is too long, before the floating body has reached the end point of the backward movement, under the multiple actions of the constant wind force and sea current force, the anchoring system will have been straightened; as huge kinetic energy of the floating structure continues to be loaded on the anchoring system while the straightened anchoring system has no more buffering capacity, the huge energy will act on the anchoring material and the connection point between the anchor and the floating body, which will lead to damages.

The present invention is achieved by the following technical solutions.

A first aspect is a constant tension anchoring system, which is mounted on a floating body on the ocean, comprising an anchor, an anchor chain, an anchor windlass, a towing cable, a load and a chain stopper; the floating body is provided with an accommodating space for accommodating the towing cable and the load, and a release switch for releasing the load; the anchor windlass is disposed on the floating body; one end of the anchor chain is connected with the anchor, the other end of the anchor chain is connected with one end of the towing cable after passing around a roller of the anchor windlass, and the other end of the towing cable is connected with the load; the chain stopper is disposed on the floating body and located on one side of the anchor windlass (the side that faces the anchor) for stopping the movement of the anchor chain or clamping (holding) the anchor chain. During normal operation, the towing cable and the load are disposed in the accommodating space, and the anchor, the anchor chain and the anchor windlass perform a normal anchoring operation; after the anchor chain is lowered, it is secured by the chain stopper. When the wind waves become stronger, the chain stopper stops securing the anchor chain, and the load is released to a seafloor by turning on the release switch while the velocity of the anchor chain is reduced by the towing cable.

As a modification of the above solution, the system further comprises a supporting device; the supporting device is disposed outside the anchor windlass and below an axial direction of the anchor or/and the towing cable. During normal operation, the supporting device is not in contact with the anchor chain or/and the towing cable; when the wind waves become stronger and the release switch is turned on, the supporting device is raised by a lifting mechanism to contact and support the anchor chain or/and the towing cable, and raise the anchor chain or/and the towing cable so that it is disengaged from the roller of the anchor windlass.

As a modification of the above solution, the system further comprises a backstop, and an outer diameter of the anchor chain is greater than an outer diameter of the towing cable. The backstop comprises a supporting base and a backstop cover. The supporting base is provided with a backstop groove having a depth greater than the outer diameter of the towing cable and smaller than the outer diameter of the anchor chain. The supporting base is disposed on the floating body and positioned between the chain stopper and the anchor windlass. One end of the backstop cover is hinged on the supporting base (i.e., the backstop cover is connected to the supporting base through hinges so that a plane of the backstop cover can rotate relative to the supporting base), and the plane of the backstop cover can rotate to cover the supporting base (and thereby the backstop groove is covered) to allow the backstop groove to form a backstop hole that only the towing cable can pass through (the anchor chain cannot pass through the backstop hole since the depth of the groove is smaller than the outer diameter of the anchor chain). The other end of the backstop cover can be fastened to the supporting base. During normal operation, the backstop cover is opened (i.e., it is not covering the supporting base), and the anchor chain is secured by the chain stopper after the anchor chain is lowered; when wind waves become stronger, the chain stopper stops securing the anchor chain and the backstop cover is closed (i.e., it is covering the supporting base).

As a modification of the above solution, the accommodating space is a compartment disposed inside the floating body, and the release switch is a gate connecting the seafloor and the accommodating space.

As a modification of the above solution, the accommodating space is a fixing mechanism disposed outside the floating body, the release switch is a clamping mechanism disposed on the fixing mechanism and connected with the load, and the towing cable is wound around a winder on the fixing mechanism.

As a modification of the above solution, the supporting device comprises a supporting roller and a lifting mechanism. The supporting roller is disposed above the lifting mechanism (at the upper end of the lifting mechanism) and positioned on one side of the anchor windlass and below the axial direction of the anchor or/and the towing cable. The lifting mechanism is hydraulically driven and configured to control upward and downward motion (vertical movements) of the supporting roller.

As a modification of the above solution, the floating body is a ship or a floating platform.

As a modification of the above solution, a weight of the load and a length of the towing cable are set to match a wave condition of design limit of the floating body.

Based on the force analysis hereinbefore of the floating body in the storm, especially for the movement of the floating body under the action of waves, the inventors have proposed the constant tension anchoring system which can withstand the storm attack. The system of the present invention has the following advantages.

When a floating body tugs the anchoring system to move backwards significantly under the action of long periodic waves in a storm, the anchoring force gradually increases; when the anchoring force increases to reach a presetting value, the anchoring system will automatically release the load which is disposed on the floating body, so as to allow the floating body, under the action of the waves, to move backwards with a generally constant anchoring force. In this case, energy is released through increasing the moving distance of the floating body, so that the forces on the anchoring system and the floating body are reduced so as to protect the anchoring system and the floating body from damage.

In the second half of the cycle of the wave motion, where the floating body follows the wave towards the original position, the tightened anchoring system becomes slack, and the force on the anchoring system becomes smaller; when the force on the anchoring force is lower than a presetting value, the anchoring system automatically retracts a portion of the anchor chain under the action of the gravity of the load, so as to reduce the length of the anchoring system while the force is maintained constant. During the oscillatory motion of the waves, the anchoring system repeats the release and retraction so as to maintain a generally constant tension force; during the wave cycles, though the wave length is great and the wave force is strong, the effective solution for anchor release and retraction allows the floating body to maintain a constant tension in a disastrous weather such as typhoon and ensure the safety of the anchoring system and the floating body.

Figure 1:
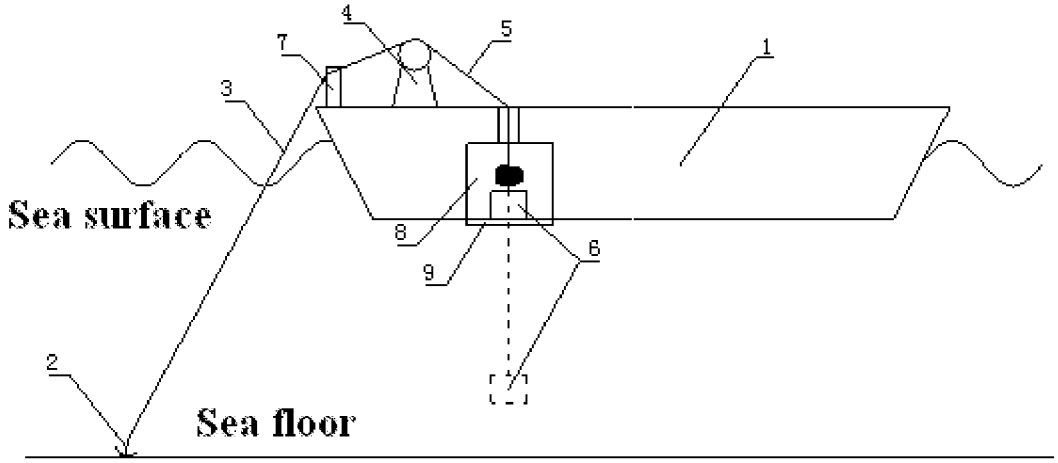
FIG. 1 shows the structure of a constant tension anchoring system of embodiment 1.

Reference signs: 1: floating body; 2: anchor; 3: anchor chain; 4: anchor windlass; 5: towing cable; 6: load; 7: chain stopper; 8: compartment; 9: gate; 10: supporting device; 11: lifting mechanism; 12: supporting roller; 13: backstop; 14: supporting base; 15: backstop cover; 16: backstop groove; 17: fixing mechanism; 18: clamping mechanism; 19: winder; 20: roller.

DETAILED DESCRIPTION OF EMBODIMENTS

The invention will be further described with reference to the drawings and embodiments. The embodiments are explanation for the present invention, but not used for limiting the invention. Also, for the convenience of description, not all of the components related to the present invention are shown in the drawings.

Embodiment 1

As shown in FIG. 1, the constant tension system is mounted on a floating body 1 on the ocean, comprising an anchor 2, an anchor chain 3, an anchor windlass 4, a towing cable 5, a load 6 and a chain stopper 7; the floating body 1 is provided with an accommodating space for accommodating the towing cable 5 and the load 6, and a release switch for releasing the load 6; the anchor windlass 4 is disposed on the floating body 1; one end of the anchor chain 3 is connected with the anchor 2, the other end of the anchor chain 3 is connected with one end of the towing cable 5 after passing around a roller 20 of the anchor windlass 4, and the other end of the towing cable 5 is connected with the load 6; the chain stopper 7 is disposed on the floating body 1 and located on one side of the anchor windlass 4 (the side that faces the anchor 2) for stopping the movement of the anchor chain 3 or clamping (holding) the anchor chain 3. During normal operation, the towing cable 5 and the load are disposed in the accommodating space, and the anchor 2, the anchor chain 3 and the anchor windlass 4 perform a normal anchoring operation; after the anchor chain 3 is lowered, it is secured by the chain stopper 7. When the wind waves become stronger, the chain stopper 7 stops securing the anchor chain 3, and the load 6 is released to above a seafloor by turning on the release switch while the velocity of the anchor chain 3 is reduced by the towing cable 5. The accommodating space is a compartment 8 disposed inside the floating body 1, and the release switch is a gate 9 connecting the seafloor and the accommodating space. The floating body 1 is a ship or a floating platform. The towing cable 5 is a steel cable.

Embodiment 2

Figure 2:
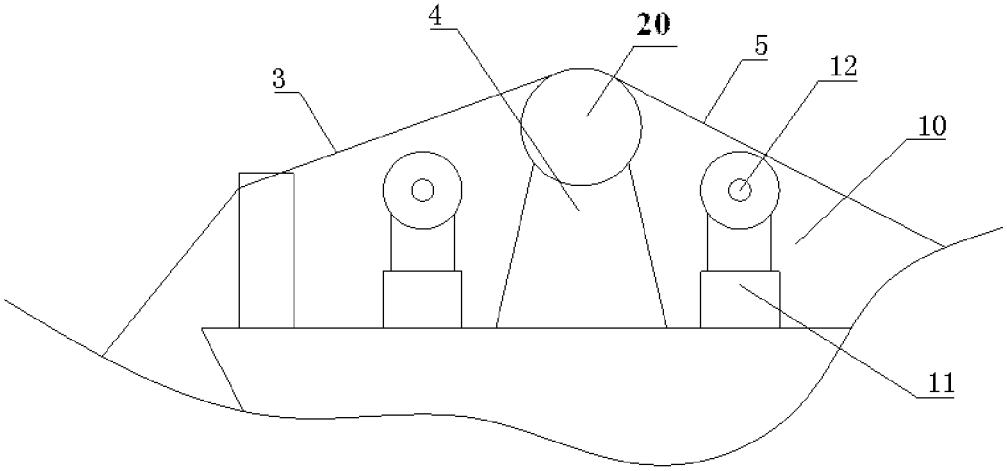
FIG. 2 shows the structure of a supporting device of embodiment 2 in a non-working state.
Figure 3:
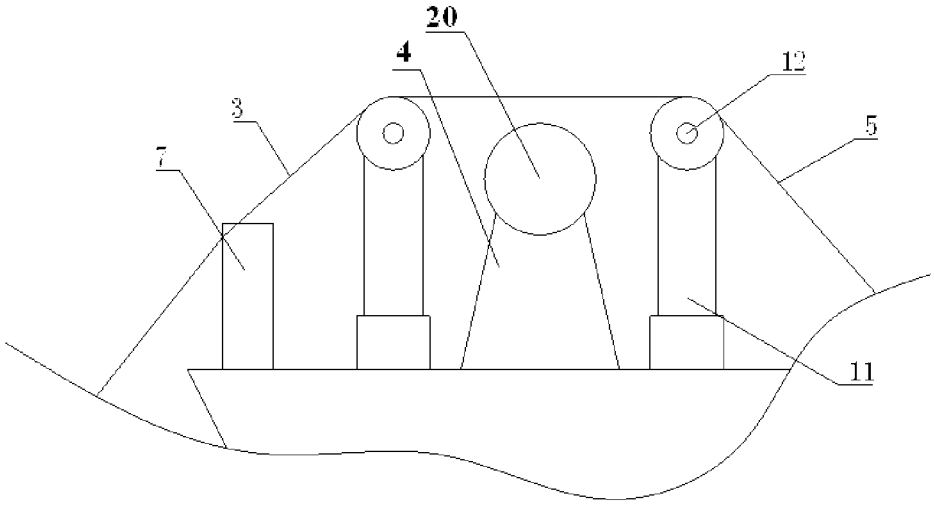
FIG. 3 shows the structure of the supporting device of embodiment 2 in a working state.

As shown in FIG. 2 and FIG. 3, the system is different from that of embodiment 1 in that, it further comprises a supporting device 10; the supporting device 10 is disposed outside the anchor windlass 4 and below an axial direction of the anchor 2 or/and the towing cable 5. During normal operation, the supporting device 10 is not in contact with the anchor chain 3 or/and the towing cable 5; when the wind waves become stronger and the release switch is turned on, the supporting device 10 is raised by a lifting mechanism 11 to support the anchor chain 3 or/and the towing cable 5, and raise it so that it is disengaged from the roller 20 of the anchor windlass 4.

The supporting device 10 comprises a lifting mechanism 11 and a supporting roller 12. The lifting mechanism 11 is hydraulically driven, provided with the supporting roller 12 at the upper end and configured to control upward and downward motions of the supporting roller 12. The supporting roller 12 is positioned on one side of the anchor windlass 4 and below the axial direction of the anchor 2 or/and the towing cable 5.

Embodiment 3

Figure 4:
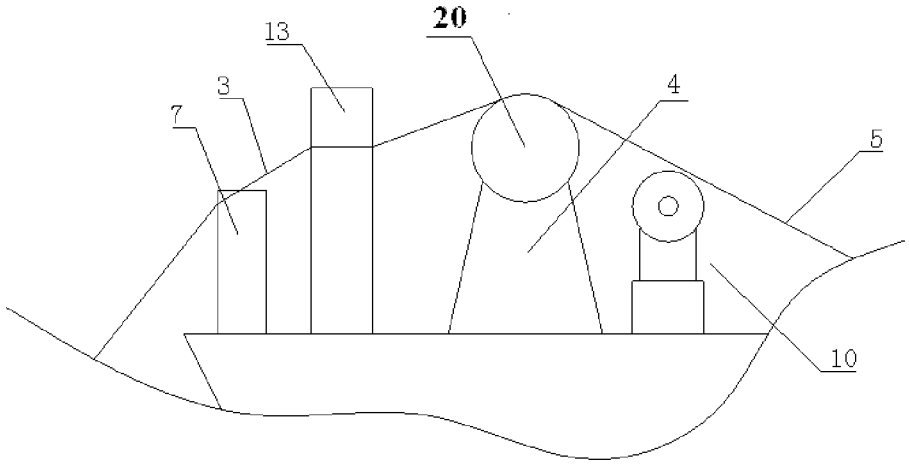
FIG. 4 shows the position of a backstop of embodiment 3 in a constant tension anchoring system.
Figure 5:
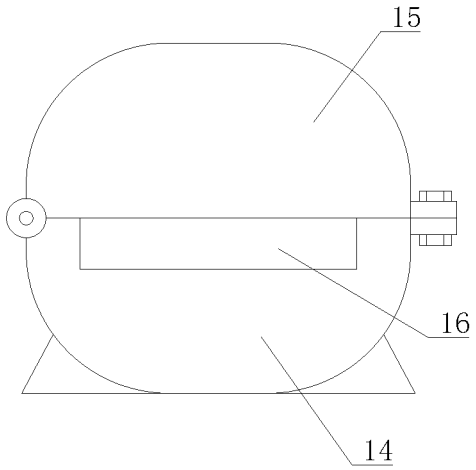
FIG. 5 shows a structure of the backstop of embodiment 3.

As shown in FIG. 4 and FIG. 5, the system is different from that of embodiment 2 in that, it further comprises a backstop 13, and an outer diameter of the anchor chain 3 is greater than an outer diameter of the towing cable 5. The backstop 13 comprises a supporting base 14 and a backstop cover 15. The supporting base 14 is provided with a backstop groove 16 having a depth greater than the outer diameter of the towing cable 5 but smaller than the outer diameter of the anchor chain 3. The supporting base 14 is disposed on the floating body 1 and positioned between the chain stopper 7 and the anchor windlass 4. One end of the backstop cover 15 is hinged on the supporting base 14 (i.e., the backstop cover 15 is connected to the supporting base 15 through hinges so that a plane of the backstop cover 15 can rotate relative to the supporting base 15), and the plane of the backstop cover 15 can be rotated to cover the supporting base 15 (and thereby the backstop groove 16 is covered) to allow the backstop groove 16 to form a backstop hole that only the towing cable 5 can pass through (the anchor chain 3 cannot pass through the backstop hole since the depth of the groove 16 is smaller than the outer diameter of the anchor chain 3). The other end of the backstop cover 15 can be fastened to the supporting base 14. During normal operation, the backstop cover 15 is opened (i.e., it is not covering the supporting base 14), and the anchor chain 3 is secured by the chain stopper 7 after the anchor chain 3 is lowered; when wind waves become stronger, the chain stopper 7 stops securing the anchor chain 3 and the backstop cover 15 is closed (i.e., the cover 15 is covering the supporting base 14 with the end fastened to the supporting base 14). The supporting device 10 adapts only a single supporting roller 12 and is disposed on the other side of the anchor windlass 4.

Embodiment 4

Figure 6:
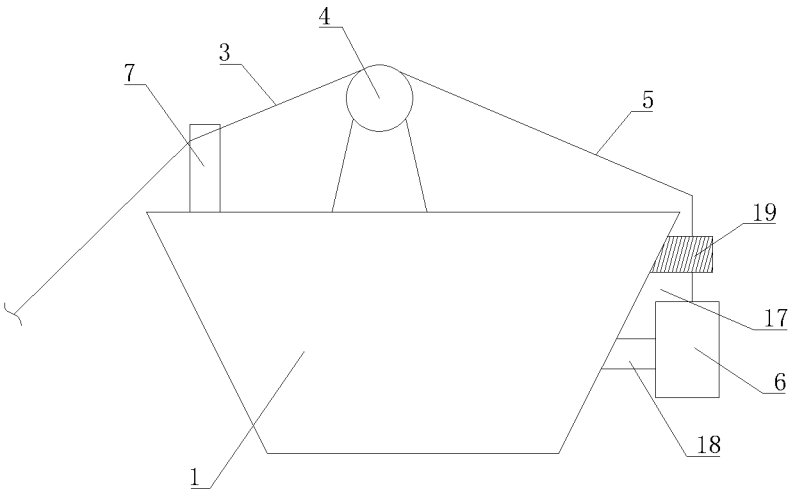
FIG. 6 shows the structure of a constant tension anchoring system of embodiment 4.

As shown in FIG. 6, the system is different from that of embodiment 1 in that, the accommodating space is a fixing mechanism 17 disposed outside the floating body 1, the release switch is a clamping mechanism 18 disposed on the fixing mechanism 17 and connected with the load 6, and the towing cable 5 is wound around a winder 19 on the fixing mechanism 19.

The above embodiments are explanation for the present invention, but not used for limiting the invention.

The invention claimed is:

1. A constant tension anchoring system mounted on a floating body in an ocean, comprising: an anchor, an anchor chain, an anchor windlass, a towing cable, a load and a chain stopper; wherein the floating body is provided with an accommodating space for accommodating the towing cable and the load, and the floating body is provided with a release switch for releasing the load;

the anchor windlass is disposed on the floating body;

a first end of the anchor chain is connected to the anchor, a second end of the anchor chain is connected to a first end of the towing cable after the second end of the anchor chain passes around a roller of the anchor windlass, and a second end of the towing cable is connected to the load;

the chain stopper is disposed on the floating body and located on a first side of the anchor windlass for stopping a movement of the anchor chain or clamping the anchor chain, wherein the first side of the anchor windlass faces the anchor;

during a normal operation, the towing cable and the load are disposed in the accommodating space, and the anchor, the anchor chain and the anchor windlass perform a normal anchoring operation; after the anchor chain is lowered, the anchor chain is secured by the chain stopper; when wind waves become stronger, the chain stopper stops securing the anchor chain, the load is released to a seafloor by turning on the release switch, and a velocity of the anchor chain is reduced by the towing cable.

2. The constant tension anchoring system according to claim 1, further comprising a supporting device; wherein the supporting device is disposed outside the anchor windlass and below an axial direction of the anchor or/and the towing cable;

during the normal operation, the supporting device is not in contact with the anchor chain or/and the towing cable; when the wind waves become stronger and the release switch is turned on, the supporting device is raised by a lifting mechanism to contact and support the anchor chain or/and the towing cable, and raise the anchor chain or/and the towing cable so that the anchor chain or/and the towing cable is disengaged from the roller of the anchor windlass.

3. The constant tension anchoring system according to claim 1, further comprising a backstop; wherein an outer diameter of the anchor chain is greater than an outer diameter of the towing cable;

the backstop comprises a supporting base and a backstop cover;

the supporting base is provided with a backstop groove, a depth of the backstop groove is greater than the outer diameter of the towing cable and smaller than the outer diameter of the anchor chain; the supporting base is disposed on the floating body and positioned between the chain stopper and the anchor windlass;

a first end of the backstop cover is hinged on the supporting base, and a plane of the backstop cover is capable of covering the supporting base to allow the backstop groove to form a backstop hole that only the towing cable can pass through; a second end of the backstop cover is capable of being fastened to the supporting base;

during the normal operation, the backstop cover is opened, and the anchor chain is secured by the chain stopper after the anchor chain is lowered; when the wind waves become stronger, the chain stopper stops securing the anchor chain and the backstop cover is closed.

4. The constant tension anchoring system according to claim 1, wherein the accommodating space is a compartment disposed inside the floating body, and the release switch is a gate connecting the seafloor to the accommodating space.

5. The constant tension anchoring system according to claim 1, wherein the accommodating space is a fixing mechanism disposed outside the floating body, the release switch is a clamping mechanism disposed on the fixing mechanism and connected to the load, and the towing cable is wound around a winder on the fixing mechanism.

6. The constant tension anchoring system according to claim 2, wherein the supporting device comprises a supporting roller and a lifting mechanism; the supporting roller is provided at an upper end of the lifting mechanism, and the supporting roller is positioned on a second side of the anchor windlass and below the axial direction of the anchor or/and the towing cable; the lifting mechanism is hydraulically driven and configured to control an upward and downward motion of the supporting roller.

7. The constant tension anchoring system according to claim 1, wherein the floating body is a ship or a floating platform.

8. The constant tension anchoring system according to claim 7, wherein a weight of the load and a length of the towing cable are set to match a wave condition of a design limit of the floating body.

9. The constant tension anchoring system according to claim 2, wherein the floating body is a ship or a floating platform.

10. The constant tension anchoring system according to claim 3, wherein the floating body is a ship or a floating platform.

11. The constant tension anchoring system according to claim 4, wherein the floating body is a ship or a floating platform.

12. The constant tension anchoring system according to claim 5, wherein the floating body is a ship or a floating platform.

13. The constant tension anchoring system according to claim 6, wherein the floating body is a ship or a floating platform.

14. The constant tension anchoring system according to claim 9, wherein a weight of the load and a length of the towing cable are set to match a wave condition of a design limit of the floating body.

15. The constant tension anchoring system according to claim 10, wherein a weight of the load and a length of the towing cable are set to match a wave condition of a design limit of the floating body.

16. The constant tension anchoring system according to claim 11, wherein a weight of the load and a length of the towing cable are set to match a wave condition of a design limit of the floating body.

17. The constant tension anchoring system according to claim 12, wherein a weight of the load and a length of the towing cable are set to match a wave condition of a design limit of the floating body.

18. The constant tension anchoring system according to claim 13, wherein a weight of the load and a length of the towing cable are set to match a wave condition of a design limit of the floating body.

* * * * *